US005700083A

United States Patent [19]

Boechel

[11] Patent Number: 5,700,083

[45] Date of Patent: Dec. 23, 1997

[54] DEVICE FOR DISPLAYING ELECTRIC LAMPS

[76] Inventor: Thomas E. Boechel, 4210 Mundy St., Blasdell, N.Y. 14219

[21] Appl. No.: 756,177

[22] Filed: Nov. 25, 1996

[51] Int. Cl.[6] ..... F21V 21/00

[52] U.S. Cl. ..... 362/249; 362/238; 362/250; 362/389; 362/806

[58] Field of Search ..... 362/238, 239, 362/249, 250, 389, 431, 806

[56] References Cited

U.S. PATENT DOCUMENTS

| | | | |
|---|---|---|---|
| 1,652,825 | 12/1927 | Hechinger | 211/26 |
| 2,722,317 | 11/1955 | Goodwin | 211/89 |
| 3,275,818 | 9/1966 | Campbell | 362/249 |
| 4,339,787 | 7/1982 | Burnbaum | 362/121 |
| 4,357,653 | 11/1982 | Kovacs | 362/388 |
| 4,523,260 | 6/1985 | Duncan | 362/121 |
| 4,769,749 | 9/1988 | Felski | 362/250 |
| 4,821,158 | 4/1989 | Mitten | 362/249 |
| 5,057,978 | 10/1991 | Conti | 362/125 |
| 5,580,160 | 12/1996 | Schuler | 362/249 |

*Primary Examiner*—Stephen F. Husar
*Attorney, Agent, or Firm*—Hodgson, Russ, Andrews, Woods & Goodyear LLP

[57] ABSTRACT

A display device for displaying ornamental electric lamps in windows or other framed structures, is described. The display device includes supporting rods which can be easily assembled and disassembled and inserted in a window frame. The supporting rods include compressible end cap means which allow the supporting rods to be adapted to fit snugly within a window, or other frame, without damaging the frame. The supporting rods further include rotatable interconnecting means for detachably engaging two or more of the supporting rods together to provide for forming a variety of configurations of the display device in the window.

19 Claims, 2 Drawing Sheets

DEVICE FOR DISPLAYING ELECTRIC LAMPS

BACKGROUND OF THE INVENTION

1. Field of the Invention

The present invention relates generally to decorative display devices and, more particularly to a device for displaying ornamental electric lamps in windows, doors or other framed structures. More specifically, the display device of the present invention includes one or more supporting rods having lamp retaining means. The supporting rods are releasably mounted in the frame of a window and the like to display the lamps through the window. The display device includes interconnecting means for releasably connecting two of the supporting rods together. The attitude of the connected supporting rods is adjustable to enable the device to be adapted for a variety of display configurations and designs. The supporting rods include compressible end members which allow the supporting rods to be adapted to fit securely within a window frame without marring the frame or without having to be fitted between parts of the window such as between the frame and the sash. In that respect, the display device of the present invention is lightweight, portable and capable of being easily assembled and disassembled for illumination in a window frame.

2. Prior Art

It is often desired to decorate homes, offices and other structures with electric lamps during certain holiday seasons such as Christmas or Hanukkah. Known means for displaying such lamps include mounting or otherwise securing the lamps and associated electrical cord directly to the window or door frame to be decorated. In addition, mounting devices for supporting the lamps and electric cord to certain structures have been proposed. Each of these means requires external hardware to attach either the lights and cord themselves or the mounting device to the window frame.

For example, U.S. Pat. No. 1,652,825 to Hechinger describes an electric lamp display device comprising a resilient light strip that is greater in length than the width of a window. In use, the ends of the light strip are secured to opposite sides of the window frame by end pieces inserted between the window frame and the sash. Not only are the end pieces prone to scratching and marring the window frame, but they severely limit the position of the light strip in the frame. The Hechinger device essentially requires that there be a sufficient gap between the frame and the sash where the end pieces of the light strip can be mounted. In modern air-tight windows, this is not practical.

A need remains for an adjustable, interconnecting, electric lamp display device which can be quickly and easily supported in the frame of a window or other like structure without the need for end pieces fitted between the frame and sash and without marring the frame. A further need remains for an electric lamp display device which can be easily reconfigured and arranged to form a variety of display designs.

SUMMARY OF THE INVENTION

A preferred embodiment of the display device of the present invention comprises one or more first or vertical support rods and one or more second or horizontal support rods. Each of the first and second support rods includes an intermediate member, lamp retaining means carried by the intermediate member, and one or more compressible end members mounted to the ends of the intermediate member.

In use, a support rod without compressible end members is first cut to a length somewhat less than the distance between spaced apart surfaces of a window frame. Compressible end members are next provided on the ends of the support rod to snuggly but firmly extend between the opposite support surfaces of the window frame, such as between the window jams or between the header and the window sill. With the support rod thusly mounted, the lights carried by the support rod are visible through the window. The display device of the present invention also includes means for rotatably interconnecting one or more of the support rods.

BRIEF DESCRIPTION OF THE DRAWINGS

For a further understanding of the invention, as well as its characterizing features, reference should now be made to the accompanying drawings wherein.

DETAILED DESCRIPTION OF THE INVENTION

Figure 1:
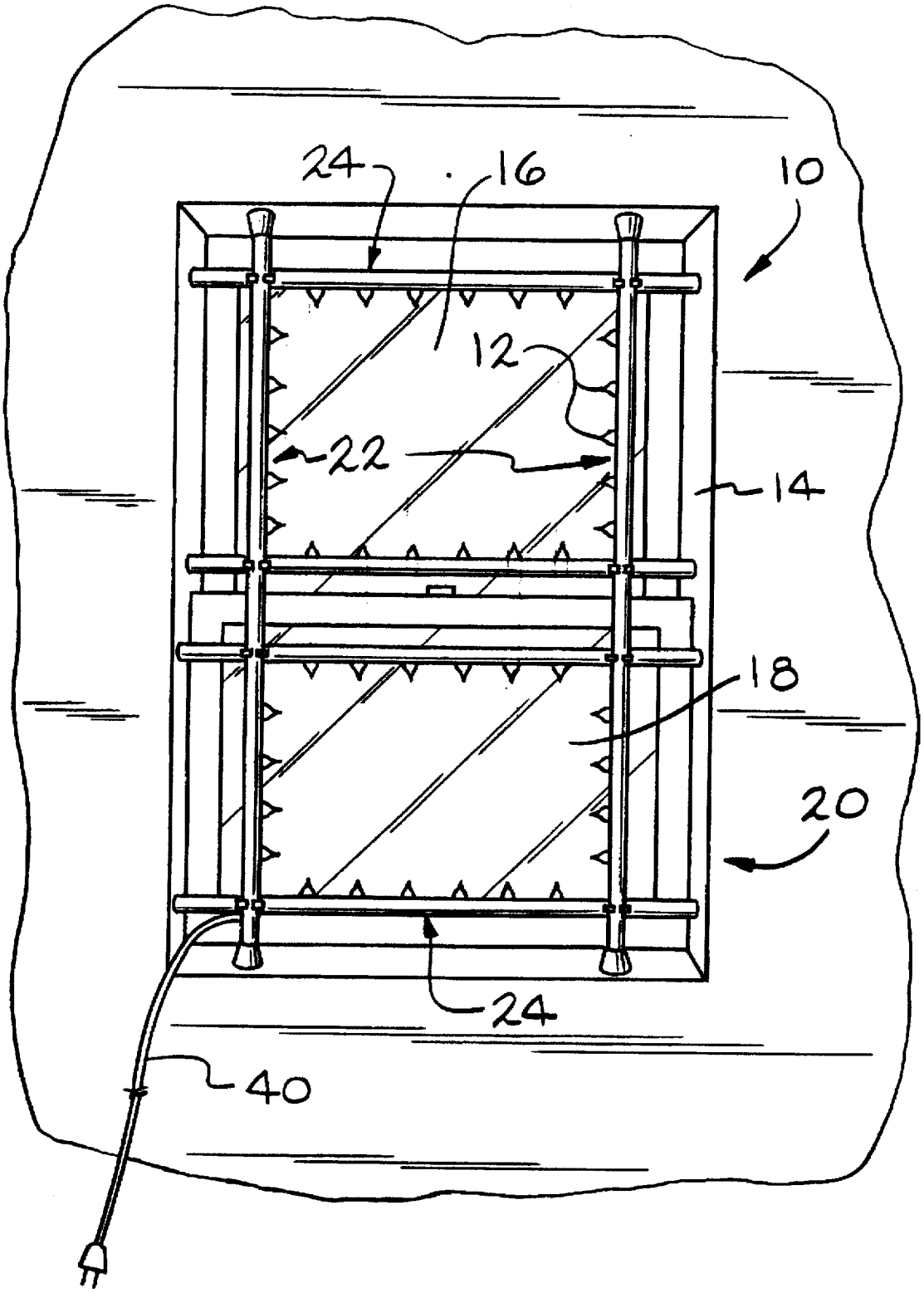
FIG. 1 is a front, elevation view of a display device 10 for displaying electric lamps according to the present invention.

Referring now to the drawings, FIG. 1 shows one preferred embodiment of a display device 10 for displaying electric lamps 12 according to the present invention. Display device 10 is positioned within a window frame 14 such that the electric lamps 12 can be viewed through window panes 16 and 18 of double hung window 20. It is intended that the electric lamps are viewable from both sides of the window, for example, from both inside a house and from the outside thereof.

Display device 10 includes one or more first or vertical support rods 22 having a plurality of the electric lamps 12 releasably supported thereto, and one or more second or horizontal support rods 24 having a plurality of the electric lamps 12 releasably supported thereto. Each first or vertical support rod 22 comprises an intermediate rod member 26 having a length sufficient to extend between the sill and the header of the window. The intermediate rod member 26 is provided with compressible end means 28 in the shape of cups. Similarly, each second or horizontal support rod 24 comprises a length of the intermediate rod member 26 sufficient to extend between the two vertical jams of the window casement. Again, the intermediate rod member 26 is provided with the compressible end means 28 having the shape of cups.

Figure 2:
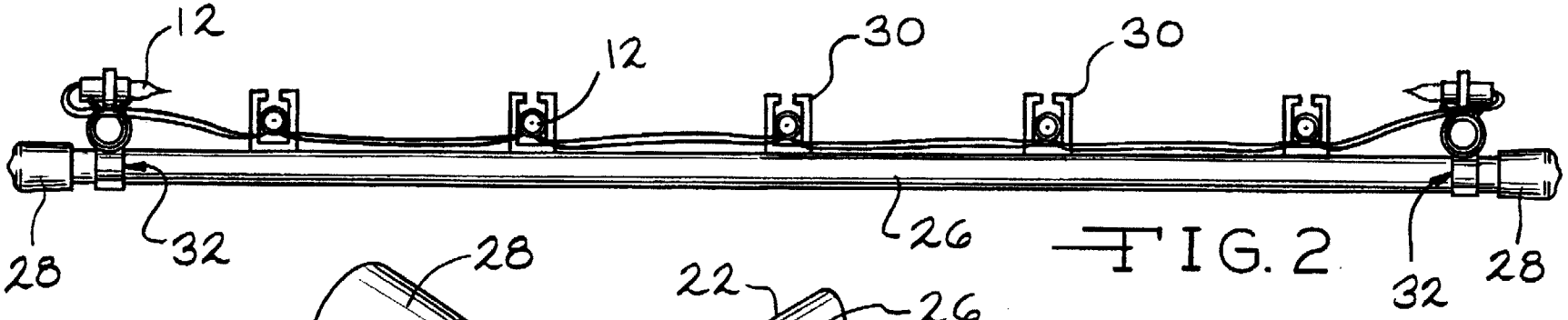
FIG. 2 is a side, elevation view of a support rod of the display device 10.
Figure 3:
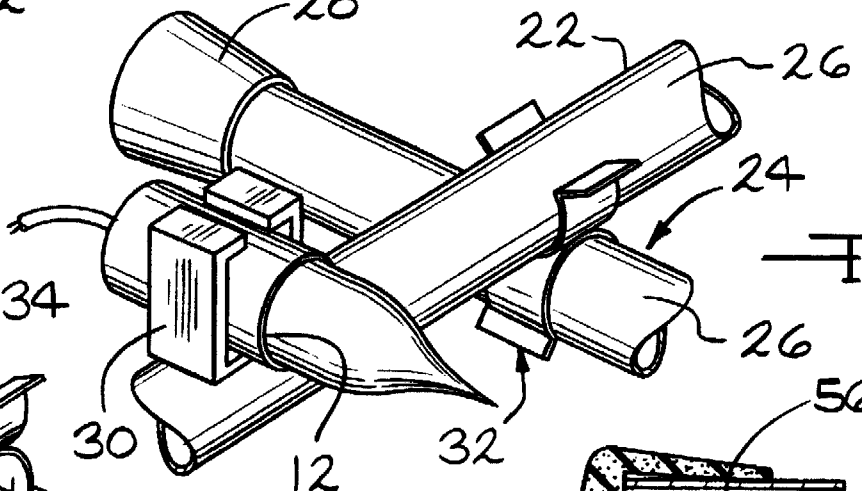
FIG. 3 is a fragmentary, perspective view of the display device 10 shown in FIG. 1 with a first support rod 22 connected to a second support rod 24.

Intermediate members 26 are preferably of a thermoplastic material and they can be provided having a cylindrical cross-sectional shape, as illustrated in FIGS. 1 to 3 and 5. Alternatively, the intermediate members 26 may be of a rigid material such as wood or metal, and they can have a flat or a generally square or other shape. FIG. 2 is a side, elevation view of either a vertical support rod 22 or a horizontal support rod 24 comprising the intermediate rod member 26 provided with compressible end cups 28.

The intermediate rod members 26 include lamp retaining means 30 in the form of U-shaped clips spaced at regular intervals along the length thereof. The lamp retaining means 30 provide for supporting the electric lamps 12 at an attitude generally normal to the longitudinal extent of the intermediate rod members 26. The lamp retaining means may be formed as an integral part of the intermediate rod member 26, or they may be mounted to the intermediate member 26 by means of rivets, clips, screws or other well known fastening means. Electric lamps 12 may be of the miniature variety or they may be larger or smaller depending on the desired overall appearance of the display.

It is envisioned that intermediate rod members 26 will be furnished in lengths sufficient to mount in virtually all windows casements found in a home and the like. For example, the intermediate rod members 26 will be sold or otherwise provided in 8 or 12 foot lengths and then cut to size by a user for a particular application. The end means 28 are preferably of a compressible, elastomeric material having spring-like characteristics, such as rubber, or rubber coated foam or sponge material. The elastomeric material provides for the intermediate members 26 of the respective vertical support 22 and horizontal support 24 to be pressure fitted into place within the window frame 14 after the intermediate members have been cut to a length nearby equal to but somewhat less than the distance between the spaced apart surfaces of the window frame provided by the sill and header or by the opposed window jams, as the case may be. For example, in use the intermediate members 26 are cut to a length of about 0.25 inches to about 0.5 inches less than the distance between the opposed surfaces of the window frame. The compressible means 28 provided at the opposed ends of the intermediate members 26 span the remaining length between the spaced apart window frame surfaces to snuggly and firmly mount the supports 22,24 in their respective vertical and horizontal attitude in the window frame.

Figure 4:
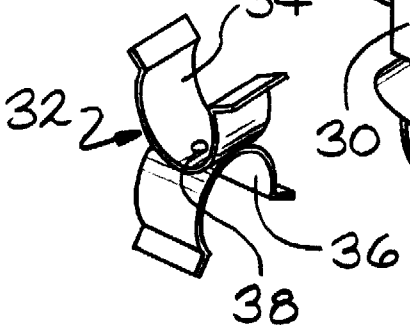
FIG. 4 is a perspective view of the interconnecting means 32 for connecting the support rods 22,24 together.

To construct the display device 10, the horizontal support rods 24 are connected to the vertical support rods 22 by interconnecting clip means 32 to provide a structure for supporting the electric lamps 12 in the window 20 or a door frame and the like. As shown in FIG. 4, the interconnecting clip means 32 are constructed of two U-shaped clasps 34, 36 positioned back-to-back and pivotably connected to each other by a pivot means such as rivet 38. That way, the interconnecting means 32 can be adjustably clipped to each of the vertical and horizontal supports 22 and 24 at any position along the length of the intermediate rod members 26 comprising the supports 22, 24. While the vertical support rods 22 and the horizontal support rods 24 are shown in a rectangular configuration, that is by way of example only. The pivotable structure of the interconnecting means 32 enables the supports 22, 24 to be pivoted with respect to each other to provide for a myriad of configurations for the display device 10 in addition to the rectangular configuration shown.

In the preferred embodiment shown in FIG. 1, the interconnecting means B2 are used to connect the horizontal support rods 24 together with the vertical support rods 22 to generally form a border around the perimeter of the window panes 16 and 18. When lamps 12 are provided with electricity by means of electric cord 40 plugged into a power source, lamps 12 illuminate and provide a decorative frame to double hung window 20. However, as previously discussed, it is contemplated by the scope of the present invention that support rods 22 and 24 can be configured within window 20 in attitudes other than the respective vertical and horizontal positions shown. Thus, the supports 22, 24 can be configured in the shape of stars, triangles and any other geometric shape as the imagination will allow. All of these variations of the present invention remain within the scope of the present invention.

Thus, an important benefit of the present invention is that the vertical support rod 22 can extend between the sill and header at any position along the horizontal extent of the window frame 14, and that the horizontal support rod 24 can extend between the opposed jams at any position along the vertical extent of the window frame 14 connected to at least one vertical support 22 by an interconnecting clip means 26, depending on the display configuration desired. This is accomplished without the need to use end pieces wedged between the window frame and the window sash, as in the prior art. Such end pieces not only can damage the window frame and sash, but they severely limit the variety of configurations for the display device, and in any event may be entirely impractical in air-tight windows. Thus, unlike the prior art electric lamp display device, the display device of the present invention can be mounted and re-mounted in a window frame without damage or otherwise harming the frame.

Figure 5:
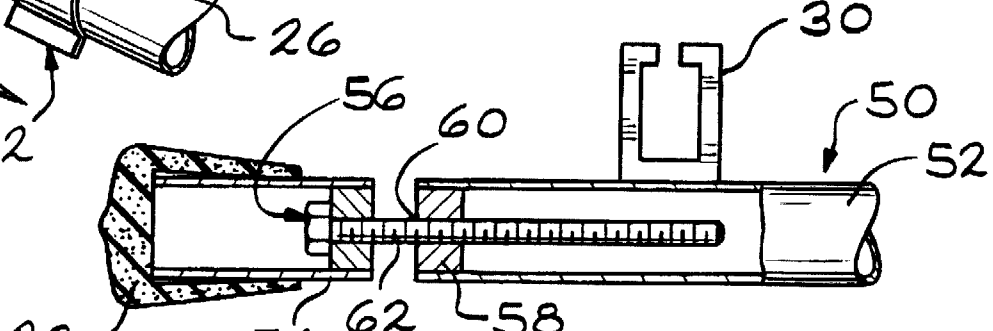
FIG. 5 is a side, cross-sectional view of an alternate embodiment of a support rod 50 according to the present invention.

FIG. 5 shows a cross sectional view of an alternate embodiment of a support rod 50 according to the present invention including an intermediate rod member 52 adjustably connected to an end member 54 by a threaded member 56. End member 56 also includes compressible end means 28. In this embodiment of the present invention, intermediate rod member 52 is cut to a length somewhat less than what is needed, for example, 6 inches less than the desired length of either the vertical or the horizontal extent of the window casement. An inset 58 is then fitted into one end of the intermediate rod member 52. Inset 58 has a threaded opening 60 that threadingly receives an adjustable means such as the threaded bolt 62 supported by the end member 54. That way, the bolt 62 is adjusted towards and away from intermediate rod member 52 depending on the direction the end member 54 is turned to threadingly engage the bolt 62 with the threaded insert 58 to thereby snuggly mount the supporting rod 50 in the window casement. The supporting rod 50 is then connected to other supporting rods by interconnecting clip means, as previously described with respect to the window display device 10 shown in FIGS. 1 to 4 to support a decorative window display according to the present invention.

From the foregoing description of an embodiment of the invention it should be evident to those skilled in the art that various changes and modifications may be made without departing from the spirit and scope of the appended claims.

What is claimed:

1. A device for displaying electric lamps in a window frame and the like, the display device comprising:

a) at least a first rod means, including:

i) a first intermediate member having a length nearly equal to but somewhat less than a first distance between spaced apart surfaces of the window frame;

ii) a plurality of first lamp retaining means provided as clip means at spaced intervals along the length of the first intermediate member; and iii) first end members provided at opposed terminal ends of the first intermediate member to fit between the spaced apart surfaces defining the first distance of the window frame;

b) a plurality of electric lamps supported by respective ones of the plurality of lamp retaining means; and c) an electric cord adapted to be connected to an electric power source to power the electric lamps.

2. The device of claim 1 further comprising:

a) a second rod means, including:

(i) a second intermediate member having a length nearly equal to but somewhat less than a second distance between spaced apart surfaces of the window frame;

(ii) a plurality of second lamp retaining means provided at spaced intervals along the length of the second intermediate member; and (iii) second end members provided at opposed terminal ends of the second intermediate member to fit between the spaced apart surfaces defining the second distance of the window frame;

b) a plurality of electric lamps supported by respective ones of the plurality of lamp retaining means;

c) an electric cord adapted to be connected to an electric power source to power the electric lamps; and d) means for releasably interconnecting the first and second rod means together.

3. The device of claim 2 wherein the first and second intermediate members and the first and second lamp retaining means are each formed as integral one piece units.

4. The device of claim 2 including at least two of the first rod means, at least two of the second rod means, and interconnecting means connecting between the first and second rod means provided in a configuration to generally form a border about the perimeter of the window frame.

5. The device of claim 1 wherein the first and second intermediate members are flexible.

6. The device of claim 1 wherein the clip means are approximately equidistant from each other.

7. The device of claim 1 wherein the clip means are generally U-shaped.

8. The device of claim 2 wherein the interconnecting means comprises two C-shape clips connected back-to-back for releasably engaging the first and second rod means.

9. The device of claim 8 wherein two C-shaped clips are pivotably connected to each other.

10. The device of claim 2 wherein the first and second end members are of a compressible material to pressure fit between the respective spaced apart surfaces of the window frame.

11. The device of claim 10 wherein the first and second end members are of an elastomeric material.

12. The device of claim 2 wherein the intermediate members are provided in a length about 0.25 inches to about 0.5 inches less than the distance between the spaced apart surfaces of the window frame.

13. A device for displaying electric lamps in a window frame and the like, the display device comprising:

a) a rod means, including:

i) an intermediate member having a length somewhat less than a distance between spaced apart surfaces of the window frame;

ii) an end member wherein one of the intermediate member and the end member is provided with a threaded insert at an open end thereof and the other of the intermediate member and the end member supports a threaded member and wherein the threaded member is threadingly mateable to the threaded insert such that the intermediate member is adjustably connected to the end member to fit between spaced apart surfaces of the window frame;

iii) a plurality of first lamp retaining means provided at spaced intervals along the length of the intermediate member;

iv) a plurality of electric lamps supported by respective ones of the plurality of lamp retaining means; and v) an electric cord adapted to be connected to an electric power source to power the electric lamps.

14. The devise of claim 13 wherein the intermediate member has a length of about 6 inches less than the distance between the spaced apart surfaces of the window frame.

15. A method of mounting a display device in a window frame, comprising the steps of:

a) measuring a first distance between spaced apart surfaces of a window frame;

b) providing a first rod means for spanning the first distance of the window frame, the first rod means comprising: a first intermediate member having a length nearly equal to but somewhat less than the first distance; a plurality of first lamp retaining means provided as clip means for releasibly receiving electric lamps at spaced intervals along the length of the first intermediate member; first end members provided at opposed terminal ends of the first intermediate member; and an electric cord adapted to be connected to an electric power source for powering the lamps;

c) supporting the first rod means between the spaced apart surfaces defining the first distance of the window frame with the opposed first end members providing a snug fit; and d) connecting the electric cord to an electric power source to power the electric lamps.

16. The method of claim 15 including providing:

a) a second rod means for spanning a second distance between spaced apart surfaces of the window frame, the second rod means comprising: a second intermediate member having a length nearly equal to but somewhat less than the second distance; a plurality of second lamp retaining means provided as clip means for releasibly receiving electric lamps at spaced intervals along the length of the second intermediate member; second end members provided at opposed terminal ends of the second intermediate member; and an electric cord adapted to be connected to an electric power source;

b) supporting the second rod means between the spaced apart surfaces defining the second distance of the window frame with the opposed second end members providing a snug fit;

c) connecting the electric cord to an electric power source to power the electric lamps; and d) interconnecting the first and second rod means together supported in the window frame with power provided to the lamps.

17. The method of claim 16 including providing two C-shaped clips pivotally connected to each other with one of the C-shaped clips clipped to the first rod means and the other C-shaped clip clipped to the second rod means interconnecting the first and second rod means together.

18. The method of claim 16 including providing the first and second end members of a compressible material to pressure fit the first and second rod means between the respective spaced apart surfaces of the window frame.

19. The method of claim 15 including providing the first intermediate member in a length about 0.25 inches to about 0.5 inches less than the first distance of the window frame.

* * * * *